US005410299A

United States Patent [19]

Hard

[11] Patent Number: 5,410,299

[45] Date of Patent: Apr. 25, 1995

[54] SMOKE DETECTOR

[76] Inventor: Mindy J. Hard, 4038 Melon Dr., St. Louis, Mo. 63125

[21] Appl. No.: 972,249

[22] Filed: Nov. 5, 1992

[51] Int. Cl.[6] ..... G08B 17/10

[52] U.S. Cl. ..... 340/628; 340/629; 340/630; 340/632; 126/299 R

[58] Field of Search ..... 340/628, 629, 630, 632; 126/299 R

[56] References Cited

U.S. PATENT DOCUMENTS 3,826,180 7/1974 Hayashi ..... 340/628

4,383,251 5/1983 Perelli et al. ..... 340/628

4,600,314 7/1986 Theriault ..... 340/628

5,300,923 4/1994 Gruber ..... 340/628

*Primary Examiner*—John K. Peng

*Assistant Examiner*—Edward Lefkowitz

*Attorney, Agent, or Firm*—Heller & Kepler

[57] ABSTRACT

An improved smoke detector in combination with a fan assembly for reducing the likelihood of smoke detector activation by ambient smoke, has a fan with a timer controlling the fan's motor to automatically shut off the fan either when the time has expired or if the timer fails.

17 Claims, 3 Drawing Sheets

SMOKE DETECTOR

BACKGROUND OF THE INVENTION

The present invention relates in general to smoke detectors and pertains, more particularly, to a combination smoke detector in combination with a fan for reducing the likelihood of smoke detector activation by ambient smoke. The improved smoke detector of this invention is an improvement over the conventional smoke detectors with variable sensitivity controls.

With the conventional smoke detector it is generally necessary to provide a deterrent in the event of an expected increase in the ambient smoke within a space provided with smoke detectors or adjacent to smoke detector locations.

Ambient smoke for the purposes of this invention is considered to be that smoke or particulate which is normally present in the environment. For example, in a home there will always be a particular amount of smoke or particulate present in the air. However, in a home for example, it can be anticipated that the ambient smoke will likely increase when food is cooked in a kitchen.

While most kitchens will not have smoke detectors, it is well known that burning toast or just normal cooking in a room adjacent to the location of a smoke detector will likely activate the nearest smoke detector's alarm.

The response to this "false alarm" is often to turn on an exhaust fan, wave a magazine or newspaper, or shut a door. However, another drawback associated with this problem is the response which includes the removal of the battery or otherwise shutting off power to the detector.

Existing smoke detectors also have a drawback associated with the sensitivity controls especially if the control is not returned to normal sensitivity or if the control malfunctions.

SUMMARY OF THE INVENTION

Accordingly, it is an object of the present invention to provide an improved smoke detector that is adapted to temporarily reduce the ability of the ambient smoke to reach the detector. With the improved smoke detector of this invention the sensitivity of the smoke detector is not altered.

Another object of the present invention is to provide an improved smoke detector that is constructed to provide a flow of air directed away from the smoke detector and a timer to control the length of time that the airflow is directed away from the smoke detector.

A further object of the present invention is to provide a smoke detector that is adapted for use in a variety of locations and controlled by different type of switches and timers to suit the location of the smoke detector.

Still another object of the present invention is to provide an improved smoke detector in which the improvements can be adapted to existing smoke detectors.

To accomplish the foregoing and other objects of this invention there is provided an improved smoke detector for reducing the amount of ambient smoke in the vicinity of the smoke detector. The improved smoke detector comprises a smoke detector, a fan associated with the smoke detector and means for operating the fan and timing the length of time the fan operates.

The improvement is believed to operate with any type of smoke detectors. Two commonly used smoke detectors are the ionization type smoke detector and the photoelectric type smoke detector.

It is possible that the present invention will work more efficiently with the ionization type detector since it is activated by particulate which may be present even if smoke is not visible, while the photoelectric type of smoke detector is activated by an increase in smoke density. Tests are required to determine the efficacy of the present invention in an assembly with a particular type and brand of smoke detector. However, this relates to the efficiency of the present invention.

The present invention lends itself to a variety of methods for turning on the fan motor and timing the fan motor operation. Pull cords, switches, buttons, and timers are but a few of the possible ways to allow a user to operate the present invention and set the time that the fan operates.

The timer used in association with the present invention opens the power circuit to the fan motor if the timer fails or if power is lost. This insures that the smoke detector will return to its normal operation.

In the disclosed embodiment described herein, there are provided an electric fan motor and a means to test fan operation. An indicator light can be provided to indicate that the fan is running or that there is still time on left on the timer.

To accomplish the method of the present invention there is disclosed in general the steps of preventing the likelihood of smoke detector activation by ambient smoke. The ambient smoke in the preferred embodiment is kept away from the smoke detector by locating a fan adjacent to the smoke detector so that in operation the fan tends to move ambient smoke away from the smoke detector.

Fan operation is timed. When fan operation ceases, then the smoke detector resumes sampling for ambient smoke without having had to of altered the sensitivity of the smoke detector. Operating the timer with a fail to open circuit mechanism results in the fan ceasing operation if, for example, power fails or the timer fails. In one preferred embodiment the timer can be set for a desired time period.

These and other features of the present invention will be better understood and appreciated from the following detailed description of preferred embodiments thereof, selected for purposes of illustration and shown in the accompanying drawings.

DETAILED DESCRIPTION

Figure 1:
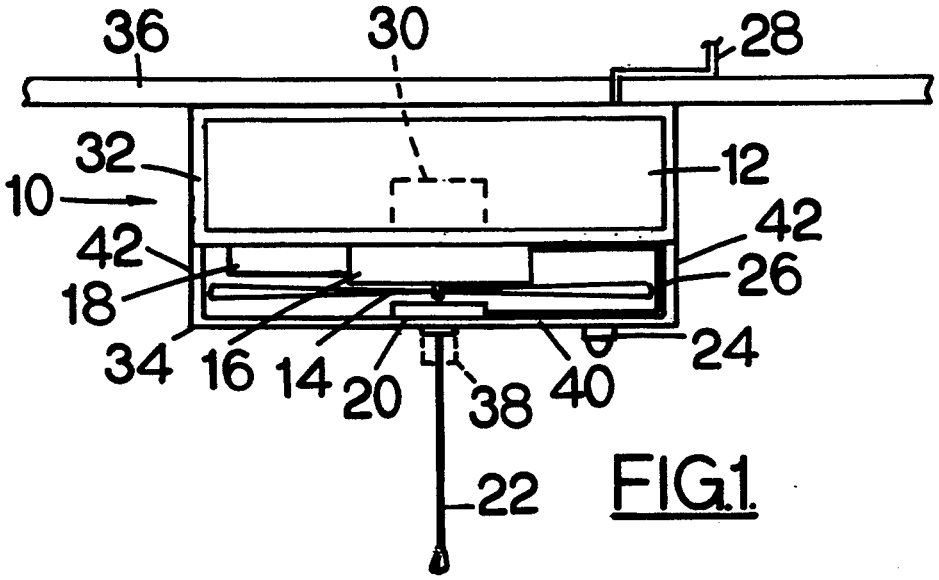
FIGS. 1–9 are schematics of an improved smoke detector assembled in accordance with the present invention and illustrated with a variety of optional features and variations.
Figure 2:
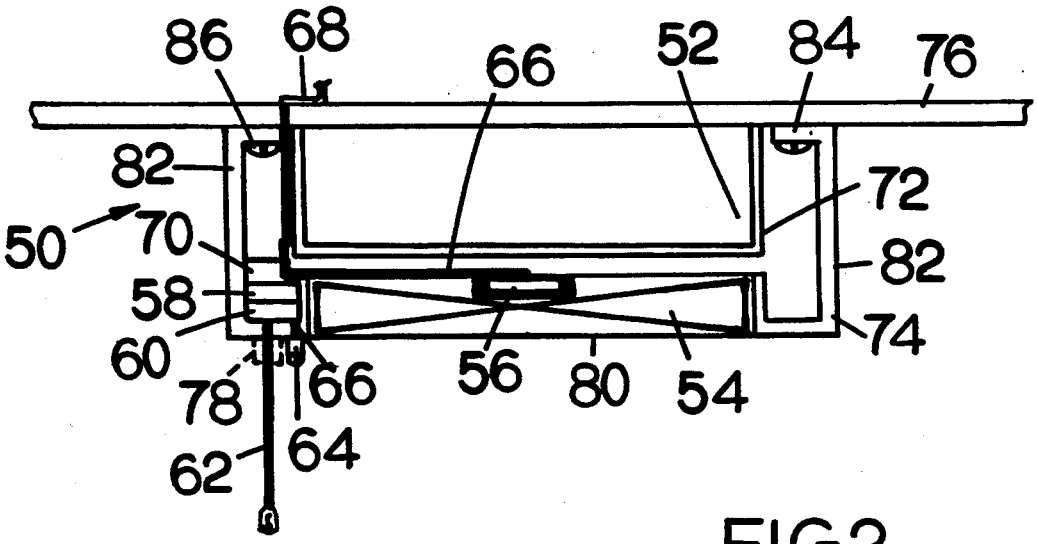

Referring now to the drawings there is shown a number of preferred embodiments for the improved smoke detector of this invention. The improved smoke detector is described in connection with a home use and a commercial or industrial use to reduce the likelihood of smoke detector activation by ambient smoke.

The improved smoke detector of the present invention is particularly adapted for providing fewer false alarms and is characterized by an improved decrease in the likelihood of false alarms when properly used in or proximate to areas in which there are activities that increase the ambient smoke for a limited period of time.

The drawings show one preferred embodiment 10 of a smoke detector assembly that includes a conventional smoke detector 12 of the desired type in combination with a fan 14. The fan is powered by a fan motor 16 and the duration of fan operation is controlled by a timer 18. It will be understood that the fan and motor as well as the timer are conventional components and that no further description is required since their operation will be readily understood by one skilled in the art.

A conventional fan motor switch 20 is activated in this embodiment by a switch pull 22 which could be a string or a chain or equivalent member that allows the fan to be activated. In one preferred embodiment the fan motor timer is pre-set to allow fan motor operation for the particular length of time for which the timer is set.

A test switch 24 can be provided to insure proper operation of the fan motor and fan. An optional ready or power light 24 can be provided. This light can be used in addition to the standard ready light with which smoke detectors are almost always provided. This light could also be used for the dual purpose of fan ready/fan operation/smoke detector ready. This latter combination could be or particular use in embodiments of the present invention which are manufactured as integral units with the fan and fan motor assembly provided with the smoke detector.

Intermediate wiring is identified in the schematic as 26 and power supply wiring (if the smoke detector uses only external power or both an external and battery power in combination) is identified as 28. The smoke detector assembly power can be supplied by a battery 30 or the battery could be used for back up in the case of power failure.

The smoke detector housing will include a grille 32 that provides the internal sensor assembly with communication with the air around the smoke detector.

A fan assembly housing 34 provides support for the fan and associated components. The illustrated embodiment is mounted on a ceiling or wall 36 and, if mounted on a wall, would have an alternative fan power switch 38 accessible to a user.

The fan assembly housing is further comprised of an exhaust grille 40 to keep foreign objects out of the fan while allowing for air flow from the fan. An intake grille or grilles 42 can be located appropriately proximate the fan and will be located, if possible, to avoid short circuiting of the air flow.

Referring again to the drawings there is shown an improved smoke detector assembly 50 which combines an existing conventional smoke detector 52 with a fan 54 and associated fan motor 56, timer 58, fan motor switch 60, switch pull 62 (for ceiling mounting), test switch with optional ready and/or power light 64 (separate from smoke detector), intermediate wiring 66, and optional power supply wiring 68 or battery 70.

The smoke detector 52 includes a conventional detector housing with appropriate grille or grilles 72. A fan assembly housing 74 including fan and motor supports attaches to a ceiling or wall 76. If the unit is wall mounted then an alternative wall mounted fan power switch 78 can be used.

In a preferred embodiment the fan assembly housing 74 includes an exhaust opening with a protective grille 80. While the grille is optional, a covering separating the fan from receiving foreign objects, is preferable. The assembly housing 74 is sufficiently large to fit over the conventional smoke detector and attach to the ceiling or wall with an attachment flange 84 or equivalent structure. Suitable fasteners 86 attach the assembly housing 74 over the conventional smoke detector and to the ceiling or wall.

Figure 3:
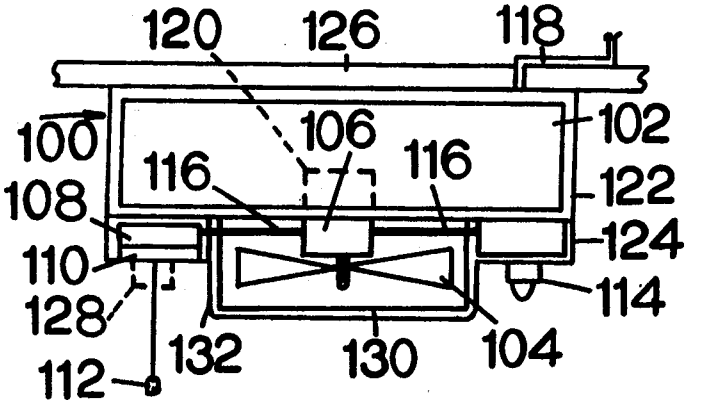

A schematic of another preferred embodiment of the present invention is depicted in FIG. 3 wherein a smoke detector assembly 100 is shown which combines a conventional smoke detector 102 and a fan 104 and associated fan motor 106. The duration of fan motor operation is controlled by a suitable timer 108. A fan motor switch 110 is operated with an attached switch pull string or chain 112. A test switch with an optional power or ready light 114 for the fan or fan and smoke detector is provided.

The operational components are connected with intermediate wiring generally indicated as 116. Power supply wiring is indicated with reference character 118. Power can be supplied by the power wiring or by a battery 120. Either arrangement can be optional depending upon the scheme used to provide power to the smoke detector.

There is a conventional detector housing 122 adapted as necessary to combine with a fan assembly housing 124 with fan and motor supports. The present invention can be mounted on either a ceiling or wall 126 and, if mounted on the wall, can use an alternative fan power switch 128 or other switch more suitable for a wall mounted combination of the present invention.

The fan housing includes an exhaust opening 130 that can have a protective grille. The fan housing will also include a suitable intake grille or grilles 132 in order to promote the desired air flow from the fan.

Figure 4:
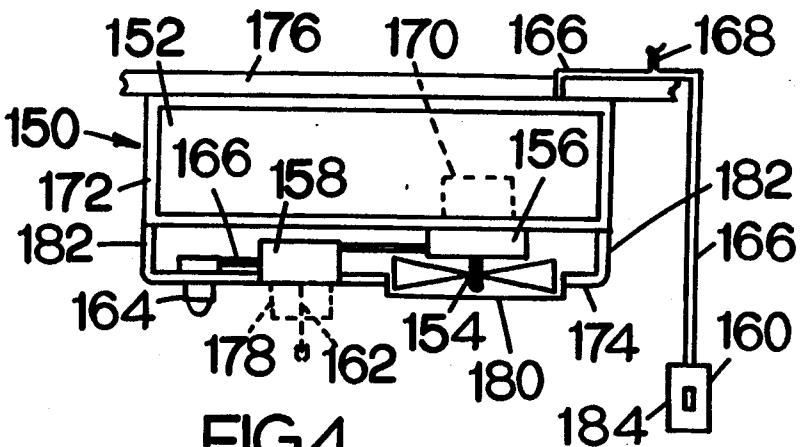

Another preferred embodiment of the present invention 150 is depicted in FIG. 4 and includes a schematic illustrating a conventional smoke detector 152 and an associated fan 154 and fan motor 156 in which the operation of the fan motor is controlled by a timer 158 as previously discussed. The embodiment of FIG. 4 depicts a wall mounted fan motor switch 160 and an optional switch and pull chain arrangement 162.

A test switch 164 is depicted and can have, as previously discussed, a ready light or power light or operation light or any desired combination thereof.

Intermediate wiring is depicted and identified as reference character 166. Similarly, power wiring is depicted and identified as reference character 168.

A conventional smoke detector housing 172 is provided or adapted for use with a fan assembly housing 174 that provides the desired fan and fan motor supports, as well as support for the other components of the present invention.

The illustrated embodiment is shown attached to either a ceiling or wall 176. An optional fan power switch 178, for example a push button switch, is depicted and would be suitable for either the ceiling or the wall mounted arrangement.

An exhaust opening 180 and grille (optional, as previously discussed) is provided for fan exhaust. One or more intake grilles 182 can be located in the fan assembly housing or otherwise provided to allow air flow through the fan, preferably without short circuiting between the exhaust and the intake.

The switch 160 can be located in a standard wall switch box and wall plate arrangement 184 suitable for the environment. The type of switch may vary, especially since this switch arrangement may be found more often than not in a commercial or industrial environment.

Figure 5:
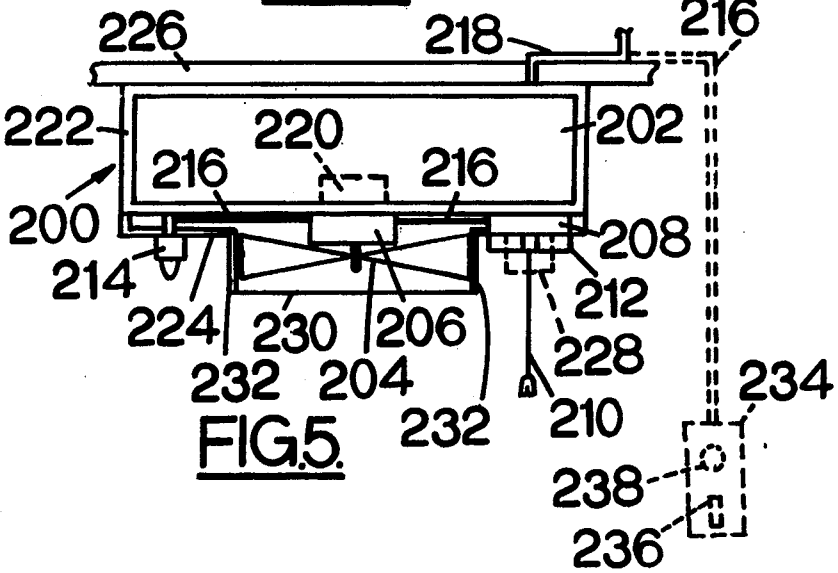

Referring now to FIG. 5 there is illustrated another preferred embodiment of the smoke detector assembly 200 of the present invention incorporating an otherwise conventional smoke detector 202 in combination with a fan 204.

The fan is operated by fan motor 206. A timer 208 controls the length of time that the fan motor operates. In this embodiment there is shown that the duration of fan motor operation can be controlled by a switch, such as dial switch 212 with suitable indicia (not shown) corresponding to the desired time which the motor is to operate the fan.

Intermediate wiring is shown as 216 and power wiring is indicated as 218. A battery 220 can be used to power the fan and/or the smoke detector or the battery can be provided for back up purposes.

There is shown in FIG. 5 the combination of a conventional detector housing 222 and a fan assembly 224 having suitable fan and motor supports. The combination is adapted for mounting on a ceiling or wall 226.

Operation of the smoke detector assembly can also be controlled by an alternative fan power switch 228 shown proximate an exhaust opening 230 and a grille, if desired. The assembly has one or more intake grilles 232 located to allow proficient operation of the fan.

A variety of switch arrangements are depicted, including a wall plate 234 with a wall switch 236 or a dial switch 238 mounted in the wall for convenience and timer control as described above.

Figure 6:
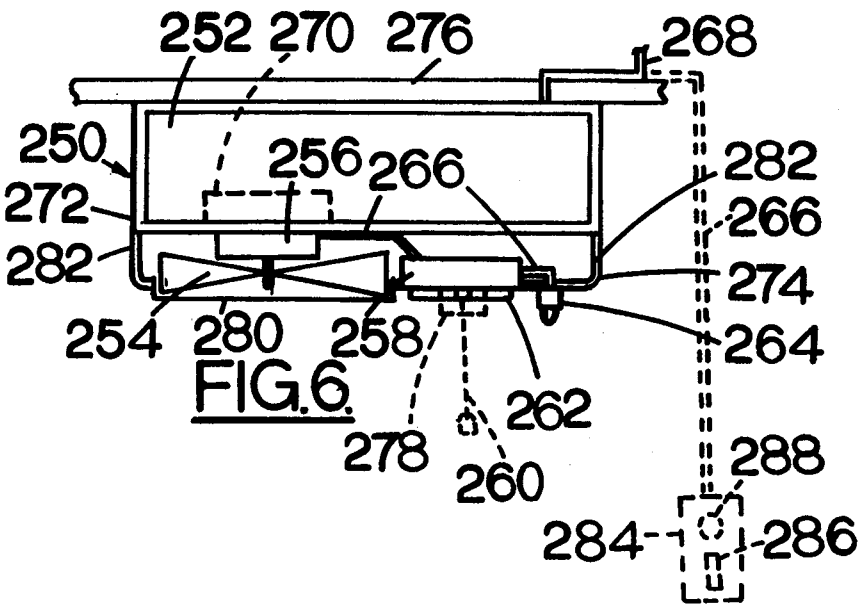

Another embodiment 250 is depicted in FIG. 6 and includes a conventional smoke detector 252 and a fan 254 operated by a fan motor 256 and a timer 258 to direct a stream of air away from the smoke detector in order to avoid a false alarm.

A variety of switch arrangements are depicted such as a fan motor switch 260 and pull chain, or a dial switch for controlling timer operation by setting the duration of fan motor operation. A test switch 264 can be provided as discussed earlier.

Intermediate wiring between the components is identified as 266 and power wiring is depicted as 268. Power can be supplied by hard wiring the smoke detector and/or fan or including an optional battery 270 for powering the smoke detector and/or the fan motor.

A conventional detector housing 272 is adapted or modified to accept or be integral with a fan assembly 272 which is suitable for supporting the fan and fan motor as well as any other components, as required.

The assembly is mounted on the ceiling or wall 276. A power switch 278, such as a push button switch can be used.

The assembly includes a suitable exhaust opening 280 with protective grille, if desired. An intake grille or grilles 282 provide for fan supply air that is pulled in by the fan and expelled through the exhaust.

A wall plate 284 suitable for the environment in which the assembly is located can be provided. There can be provided a wall switch 286 for activating the fan motor and timer. A dial switch 288 can be located on them all rather than or in addition to the dial on the assembly.

Figures 7, 8, 9:
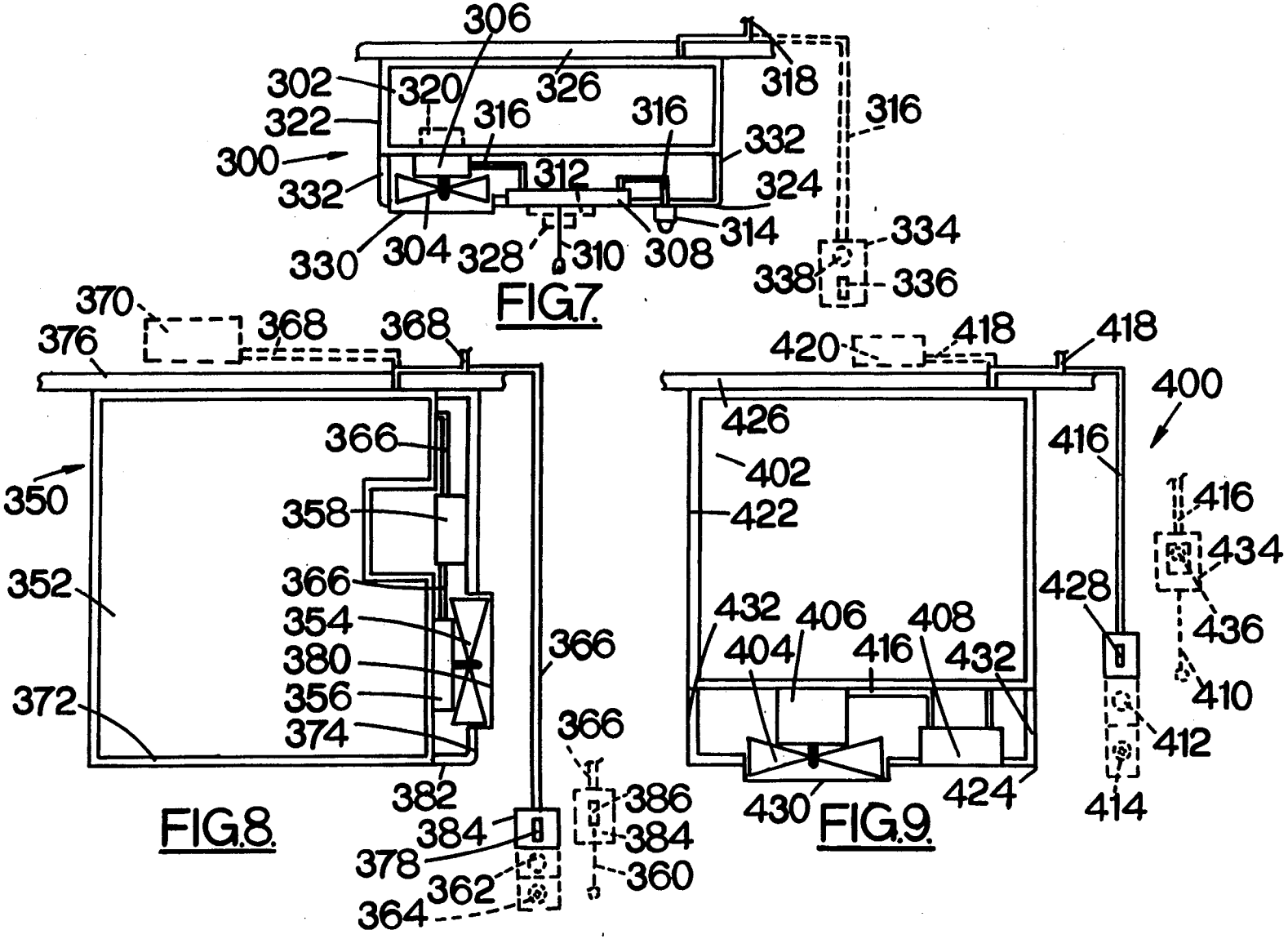

Another preferred embodiment 300 of the smoke detector assembly is depicted in FIG. 7. A conventional smoke detector 302 or a smoke detector adapted for the present invention is provided with a fan 304 and an associated fan motor 306. A suitable timer 308 determines the length of time that the fan motor operates. The fan motor can be activated with a switch and pull cord or chain 310 or a dial switch 312. The dial switch can be an off-on switch or allow the setting of a particular time for fan motor operation.

It is desired that a test switch 314 be provided for testing the fan motor and fan or the smoke detector or both.

Intermediate wiring is depicted as 316 and power wiring is depicted as 318. A battery 320 can be an option. The wiring can be modified to suit the desired method of powering the assembly.

A conventional detector housing 322 can be altered or modified to accept a fan assembly housing 324 for the fan and fan motor. Alternatively, the unit 300 can be manufactured as a unit. This is true for all of the embodiments described herein, except for the unit clearly intended to fit over an existing smoke detector.

The assembly 300 can be either ceiling or wall 326 mounted. The type of switch provided will depend upon the mounting of the unit. Fan switch 328, however, is suitable for either mounting so long as the switch can be reached, if mounted on the ceiling for example.

Exhaust opening and grille (if desired) 330 and intake grille 332 provide for air flow through the unit and out as the fan discharge.

Controls, as previously discussed, can vary and a few of the variations include a suitable wall mounting plate 334 with a wall mounted switch 336 and/or a dial timer switch 338 for activating the fan motor and/or setting the desired time of fan motor operation.

The final two embodiments illustrated in FIGS. 8 and 9 are intended to represent commercial smoke detectors which often have a distinctive can shape and are powered by a remote power source with the option of a battery back up system.

The embodiments depicted 350, 400 include a conventional commercial smoke detector 352, 402 in association with a fan 354, 404 and fan motor 356, 406 wherein the fan motor operation is timed by a suitable timer 358, 408.

Depending upon the location and orientation of installation, the assembly can have an optional pull switch 360, 410 and/or a dial type timer switch 362, 412 for operating the fan motor and preferably setting a desired time of operation. A test switch 364, 414 as discussed previously, with a power or activation or ready light (or some combination thereof).

Intermediate wiring is depicted as 366, 416 and power supply wiring is shown as 368, 418. A battery 370, 420 probably for back up in a commercial unit, is shown in the drawings and located away from the unit. The battery could also be located within the unit.

A conventional commercial detector housing is shown 372, 422 with a fan assembly located to the side of 374 or beneath 424 the smoke detector housing. The fan assembly preferably provides the necessary support for the fan and fan motor and associated components.

The unit 350, 400 can be mounted on ceiling or wall 376, 426 as desired. A fan power switch 378, 428 could be located on the unit but is preferably provided remotely for ease of use. This may be particularly true in the commercial or industrial locations in which the smoke detectors are mounted on the ceiling or an the wall substantially out of reach from the floor of the are in which they are installed.

An exhaust opening 380, 430 with optional exhaust grille and an intake grille 382, 432 are provided just as in the previous examples of the present invention.

A wall plate 384, 434 with switches, dials, and/or buttons is depicted in the drawings. An optional wall switch and pull cord 386, 436 can be used, particularly if the wall switch is mounted relatively high above the floor of a commercial or industrial building.

In operation, in connection with the smoke detector applications previously mentioned to reduce the likelihood of the smoke detector activating due to excessive ambient smoke not due to a fire, and thereby issuing a false alarm, the fan is located adjacent or proximate the smoke detector with the fan and intake and exhaust openings provided so that the fan tends to move any ambient smoke away from the smoke detector. The fan is operated when the ambient smoke is expected to increase from activities such as cooking.

Fan operation is timed by the timer. In this way the fan operation is independent of the operator, and the fan cannot be left on inadvertently. The timer shuts off the fan after the pre-set or operator set length of time. Once the fan stops operating the smoke detector resumes unhindered operation and continues to monitor the ambient smoke.

In a preferred embodiment the timer is either an electronic timer or a mechanical timer. If a mechanical timer is used, then the timer closes a timer related circuit upon timer failure or power failure such that the fan ceases operation upon failure of the timer or loss of power to the timer.

Similarly, if an electronic timer is used, then the length of time that the fan operates is controlled electronically. The timer includes means for closing a timing circuit upon timer failure or power failure such that the fan ceases operation upon failure of the timer or loss of power to the timer.

From the foregoing description those skilled in the art will appreciate that all of the objects of the present invention are realized. An improved smoke detector has been shown and described for reducing the likelihood of smoke detector activation by ambient smoke. The improved smoke detector is adapted to temporarily reduce the ability of the ambient smoke to reach the detector.

The use of a fan eliminates the need to modify the sensitivity of the associated smoke detector. The fan provides a flow of air directed away from the smoke detector. The timer controls the length of time that the airflow is directed away from the smoke detector.

The foregoing description and the drawings illustrate a variety of locations and controls, including conventional switches and conventional timers. Since all of the individual components illustrated and described are conventional, it will be understood that the claimed improvements can be adapted to existing smoke detectors or integrated with conventional smoke detectors.

While specific embodiments have been shown and described, many variations are possible. The particular shape of the smoke detector housing or the fan assembly housing including all dimensions may be changed as desired to suit the equipment or the location with which or where it is used. The configuration and location of the controls may vary. The location and size of the fan may also vary. In the simplest version of the present invention a fan in a cage with the appropriate motor, timer, and switch is supported adjacent an existing smoke detector. In the more elaborate version of the present invention the fan, fan motor, timer, controls, switches, and wiring are integrated into and manufactured as part of the smoke detector. The battery, if used, could be a rechargeable battery.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. An improved smoke detector in combination with a fan assembly for reducing the likelihood of smoke detector activation by ambient smoke, the combination comprising:

a smoke detector capable of detecting ambient smoke;

a fan assembly comprising an electric fan adjacent to the smoke detector, a fan motor, and a fan housing, the fan located substantially within the fan housing and the fan housing substantially enclosing the fan and the smoke detector such that the fan is capable of substantially reducing the likelihood of the ambient smoke activating the smoke detector;

means for supplying electrical power to the fan;

means for operating the fan; and means for timing the length of time the fan operates, the timing means capable of being set for a desired period of fan operation by an operator.

2. A combination as set forth in claim 1 wherein the smoke detector is an ionization-type smoke detector.

3. A combination as set forth in claim 1 wherein the smoke detector is a photoelectric type smoke detector.

4. A combination as set forth in claim 1 wherein the means for operating the fan is a pull cord attached to a fan power switch in combination with the timing means.

5. A combination as set forth in claim 1 wherein the means for timing the length the fan operates is a mechanical timer that closes a timing circuit upon failure such that the fan ceases operation upon failure of the timer.

6. An improved smoke detector in combination with a fan assembly for reducing the likelihood of smoke detector activation by ambient smoke, the combination comprising:

a smoke detector capable of detecting ambient smoke;

an electric fan and a fan motor located adjacent the smoke detector;

a fan housing substantially enclosing the fan, the fan motor, and the smoke detector such that the fan is capable of substantially moving ambient smoke away from the smoke detector thereby reducing the likelihood of the ambient smoke activating the smoke detector;

means for supplying electrical power to the fan;

means for operating the fan;

means for timing the length of time the fan operates once the fan is started, the timing means capable of being set for a desired period of fan operation by an operator, the timing means including means for shutting off the fan upon failure of the timing means, the timing means operatively associated with the fan operating means; and means for testing fan operation.

7. A combination as set forth in claim 6 wherein the smoke detector is an ionization-type smoke detector.

8. A combination as set forth in claim 6 wherein the smoke detector is a photoelectric-type smoke detector.

9. A combination as set forth in claim 6 wherein the means for operating the fan is a pull cord attached to a fan power switch.

10. An improved smoke detector in combination with a fan assembly for reducing the likelihood of smoke detector activation by ambient smoke, the combination comprising:

a smoke detector capable of detecting ambient smoke;

an electric fan and a fan motor located adjacent the smoke detector;

a fan housing substantially enclosing the fan, the fan motor, and the smoke detector such that the fan is capable of substantially moving ambient smoke away from the smoke detector thereby reducing the likelihood of the ambient smoke activating the smoke detector;

means for supplying electrical power to the fan;

means for operating the fan;

means for electronically timing the length of time the fan operates once the fan is started, the electronic timing means capable of being set for a desired period of fan operation by an operator, the electronic timing means including a normally open contact that shuts off power to the fan motor upon failure of the timing means, the timing means operatively associated with the fan operating means; and means for testing fan operation.

11. A combination as set forth in claim 10 wherein the means for operating the fan is a pull cord attached to a fan power switch.

12. A combination as set forth in claim 10 wherein the means for operating the fan is a wall mounted switch.

13. A combination as set forth in claim 10 wherein the means for operating the fan is a push button switch.

14. A combination as set forth in claim 10 wherein the means for supplying electrical power comprises a battery or batteries.

15. A method of operating an improved combination of a smoke detector and a fan assembly for reducing the likelihood of smoke detector activation by ambient smoke, the steps of the method comprising:

locating a fan adjacent to and substantially covering a smoke detector so that in operation the fan tends to move ambient smoke away from the smoke detector;

operating the fan when ambient smoke is or could be greater than normal;

setting the length of time that the fan operates;

timing the length of time that the fan operates; and shutting off the fan at the end of the length of time, thereby allowing the smoke detector to again continue to monitor the ambient smoke.

16. A combination as set forth in claim 15 further comprising the step of timing the length of time that the fan operates mechanically and closing a timing circuit upon timer failure or power failure such that the fan ceases operation upon failure of the timer or loss of power to the timer.

17. A combination as set forth in claim 15 further comprising the step of timing the length of time that the fan operates electronically and closing a timing circuit upon timer failure or power failure such that the fan ceases operation upon failure of the timer or loss of power to the timer.

* * * * *